United States Patent [19]

Lynch

[11] Patent Number: 4,459,915

[45] Date of Patent: Jul. 17, 1984

[54] COMBINED ROCKET MOTOR WARHEAD

[75] Inventor: Robert A. Lynch, San Diego, Calif.

[73] Assignee: General Dynamics Corporation/Convair Div., San Diego, Calif.

[21] Appl. No.: 434,775

[22] Filed: Oct. 18, 1982

[51] Int. Cl.[3] ..... F42B 15/24

[52] U.S. Cl. ..... 102/374; 102/473; 102/474; 102/490; 102/493; 102/499

[58] Field of Search ..... 102/374, 376, 379, 381, 102/477, 491, 492, 493, , 375, 377, 378, 380, 347, 473, 474, 481, 490, 494, 495, 499, 500

[56] References Cited

U.S. PATENT DOCUMENTS

| | | | |
|---|---|---|---|
| 3,081,704 | 3/1963 | Boswell | 102/474 |
| 3,490,373 | 1/1970 | Fox | 102/488 |
| 3,491,694 | 1/1970 | Fountain | 102/493 |
| 3,572,249 | 3/1971 | Davis | 102/491 |
| 3,696,751 | 10/1972 | Kempton | 102/474 |
| 3,799,054 | 3/1974 | La Rocca | 102/491 |
| 3,853,059 | 12/1974 | Moe | 102/493 |
| 4,058,063 | 11/1977 | Hurst | 102/474 |

*Primary Examiner*—Charles T. Jordan
*Assistant Examiner*—Ted L. Parr
*Attorney, Agent, or Firm*—John R. Duncan

[57] ABSTRACT

A solid fuel rocket in which the rocket casing acts as a warhead. Solid propellant rocket motors require relatively heavy cases to contain the 1000–2000 psi combustion pressure needed for efficient performance. This casing can be used as a fragmentation warhead by forming longitudinal grooves in the elongated rocket casing, causing the casing to fracture along the grooves and allowing the pressure within the casing to disperse the fragments. The resulting strip-like fragments are particularly useful against "soft" equipment targets, such as anti-vehicle and anti-radar applications. Several different methods for rupturing the case along spaced, parallel longitudinal lines are disclosed. This system eliminates the need for a separate warhead including case and explosive at the cost of a slight increase in propellant case thickness and weight.

6 Claims, 7 Drawing Figures

COMBINED ROCKET MOTOR WARHEAD

BACKGROUND OF THE INVENTION

This invention relates in general to rocket munitions and, more specifically, to a rocket motor which also serves as a fragmentation-type warhead.

Conventional military rockets have a rocket fuel casing with a nozzle at one end and a warhead casing at the other. The warhead may be primarily high explosive or may surround the explosive with a material which fragments into shrapnel. While these rockets are effective for many purposes, the separate warheads, often with a heavy casing, severely limits the range of the rocket, or require undesirably large rockets.

An attempt has been made, as disclosed in U.S. Pat. No. 3,572,249 to combine the solid rocket fuel and the warhead explosive in one casing. In this munition, a layer of explosive is coated on the internal wall of the casing, a layer of thermal insulation is applied thereover and the remainder of the space is filled with rocket fuel. The insulation layer consumes valuable space and weight which could better be used for additional rocket fuel. Also, since modern solid fuels burn at very high temperatures, there is a signficant risk of premature ignition of the explosive, if the insulation is insufficient or has defects. No control over fragment size or spread is provided upon casing rupture. Since the patent disclosure indicates that unburned portions of the rocket fuel may be exploded with the warhead explosive, little control over fragment size, direction and spread can be provided, since they will all vary with quantity of fuel exploded. Also, the fuel is an inefficient explosive, having been optimized as a burning fuel, not an explosive.

Thus, there is a continuing need for improved military rockets which provide greatest effectiveness at lowest weight and providing a controlled dispersion of fragments of selected size and shape.

SUMMARY OF THE INVENTION

The above-noted problems are overcome, and needs met, by a combined rocket motor and warhead which comprises an elongated casing having a rocket nozzle at one end and a quantity of solid rocket propellant therein, with fragmentation means for causing the casing to split along a plurality of lines substantially parallel to the length of said casing to produce an elongated, strip-like fragment and expulsion means for causing the fragments to spread apart, so that such fragmentation and expulsion during rocket flight will produce a plurality of fragments impacting a target along the line of flight of the rocket beyond the point where fragmentation and expulsion are initiated.

The size and shape of the fragments can be designed in accordance with the type of target against which the munition is to be used. This weapon is especially useful against "soft" targets such as communication equipment, ground or ship-based radar antennas, etc. It is suitable, for example, as a defensive rocket for use by aircraft in suppressing anti-aircraft surface-to-air missile systems.

Several different methods may be used to cause the fragmentation and fragment expulsion or separation. These are described in detail below.

BRIEF DESCRIPTION OF THE DRAWING

Details of the invention, and of several preferred embodiments thereof, will be further understood upon reference to the drawing, wherein.

DETAILED DESCRIPTION OF THE INVENTION

Figure 1:
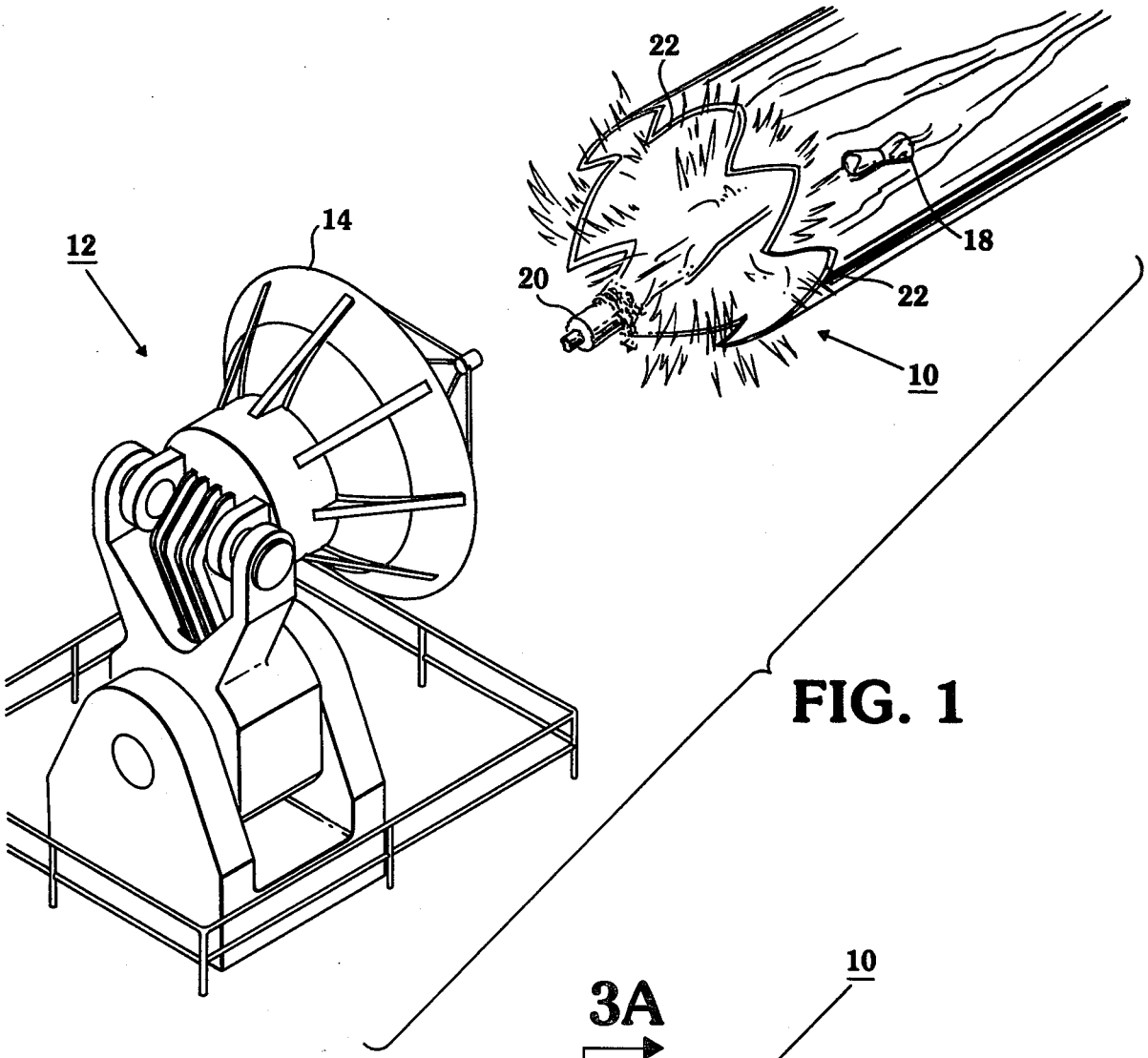
FIG. 1 is a perspective view showing the rocket attacking a ground radar facility just after the moment of fragmentation.

Referring now to FIG. 1, there is seen a missile generally designated 10 approaching a target 12. The typical target 12 is, in this example, a radar antenna 14 for a system which might, for example, be a surface-to-air missile control system. The antenna 14 is a relatively "soft" target, susceptible to distortion or severe damage when impacted by metal fragments traveling at moderate to high velocities. Missile 10, which includes the combined rocket motor and warhead of this invention, is especially adapted to destroy soft targets such as target 12.

Figure 2A:
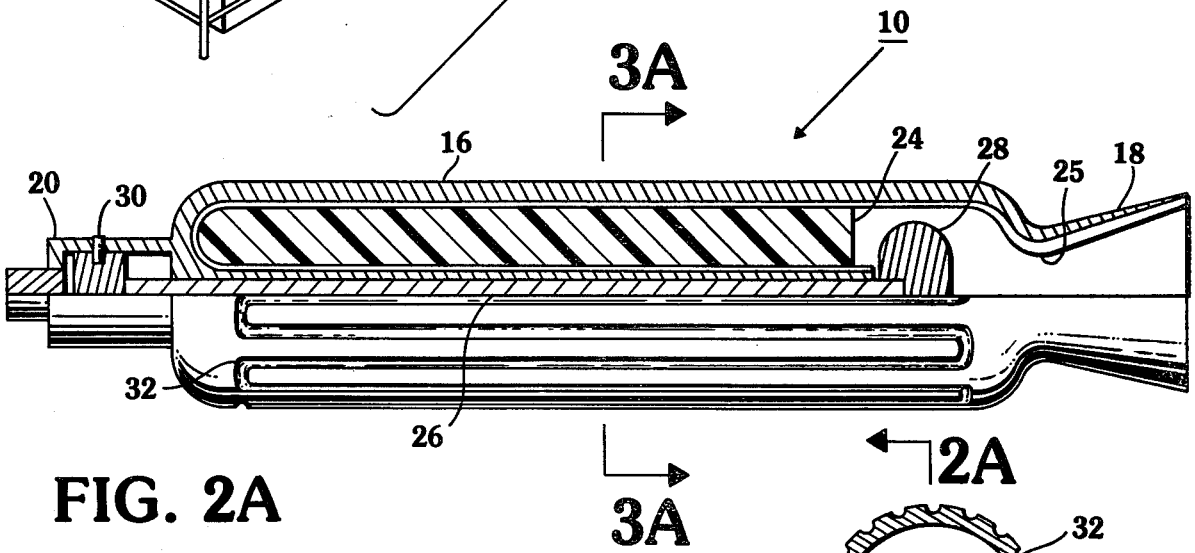
FIGS. 2*a* and 2*b* are schematic axial partial sections through a rocket illustrating one method of fragmenting the casing both before and just after initiation of fragmentation.
Figure 3A:
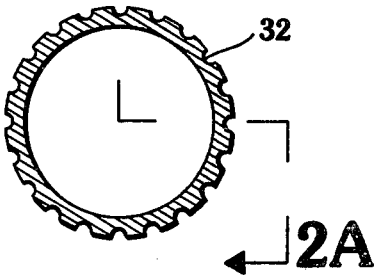
FIGS. 3*a* and 3*b* are schematic sections through the rockets of FIGS. 2*a* and 2*b*, respectively, taken on lines 2*a*—2*a* and 2*b*—2*b*.
Figure 2B:
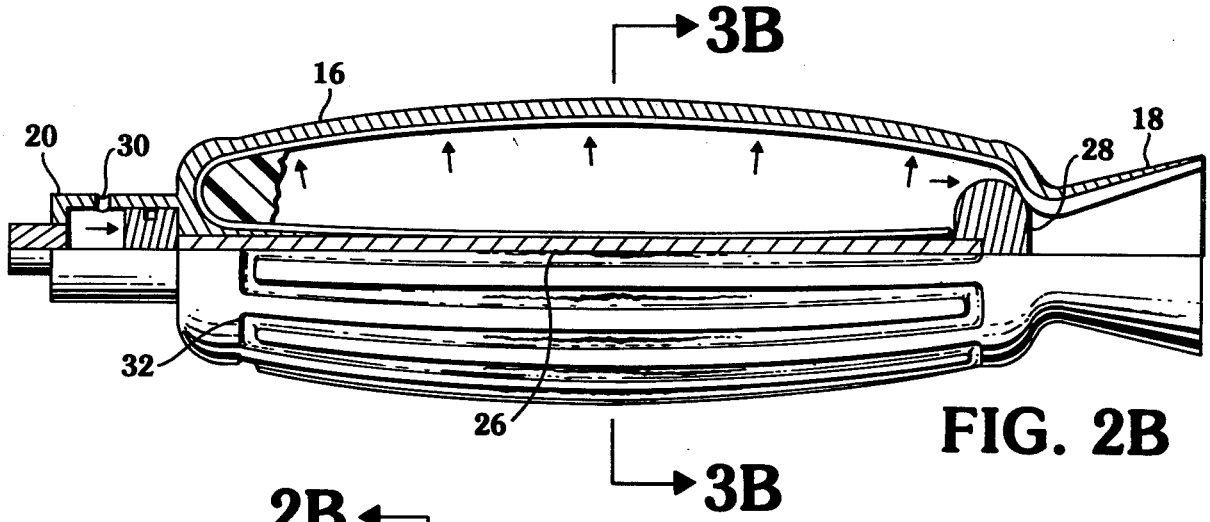
Figure 3B:
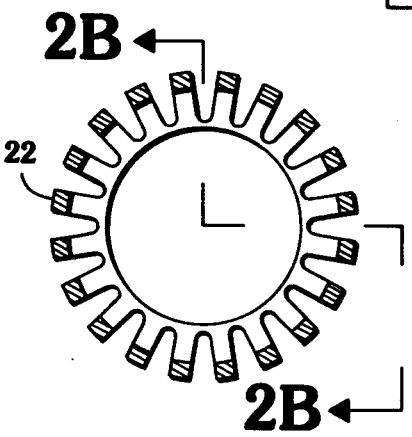
Figure 5:
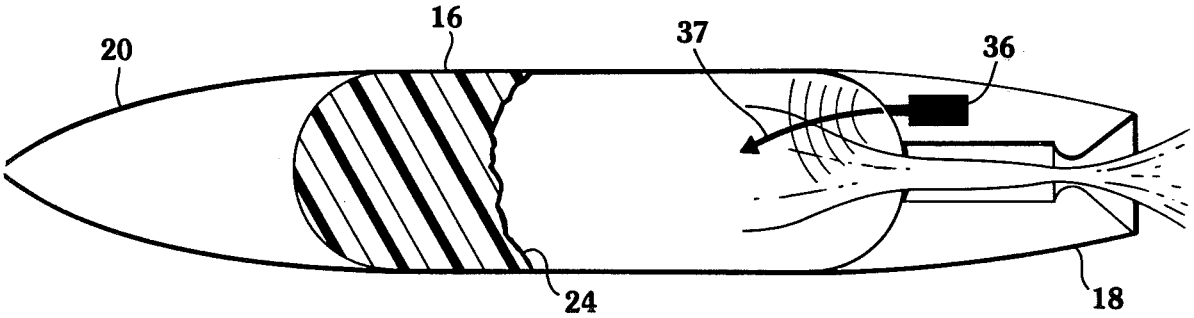
FIG. 5 is a schematic axial section through a rocket illustrating still another fragmentation technique.

Missile 10 includes an elongated rocket casing 16 (as best seen in FIGS. 2*a*, 2*b* and 5) a rocket nozzle 18 at one end and control means 20 (which may comprise guidance, target sensors, proximity fuses, etc.) at the other. When the terminal guidance means and fuse within control means 20 determine that missile 10 has reached the desired distance from target 12, casing 16 is caused to fragment and expand by one of the means described below, producing a plurality of elongated fragments 22. In a preferred embodiment, the fragments, or some of them, remain connected together at alternate ends in a "zig-zag" manner as illustrated in FIG. 1. This preferred arrangement helps the fragments remain in a pattern most likely to impact and damage target 12. Of course, for some applications, especially against larger soft targets, it may be preferable that the individual elongated fragment strips separate. I have found that the constrained strip-like fragments do greater damage than chunk-like fragments to discrete targets such as radars and vehicles. The strips tear out large sections and systems while the chunk-like fragments create multiple small penetrations which may not impair target operation.

One method of casing 16 to expand and fragment into elongated fragments 22 is illustrated in FIGS. 2*a*, 2*b*, 3*a* and 3*b*. The casing 16 containing a solid propellant 24 which burns to propel the rocket. The inside of casing 16 is lined with a protective liner 25. A rod 26 extends along the rocket axis from control means 20 to a plug mean 28 adjacent to nozzle 18. When control means 20 senses that the rocket 10 is at the appropriate distance from target 12, a latch mean 30 releases rod 26 and plug 28, which are driven rearwardly by any conventional mean, such as a small pyrotechnic or spring (not shown)

so that plug 28 closes off nozzle 18. Since the remaining propellant 24 continues to burn, a rapid over-pressure is generated within casing 16 causing the casing to expand and rupture along grooves 32 in the casing wall. The shape of the fragments will be determined by the groove pattern. A zig-zag groove will produce the generally continuous elongated fragment 22 seen in FIG. 1.

The grooved casing will, of course, have to be somewhat thicker than the usual rocket casing in order to contain the pressure of the burning propellant during rocket flight. Basically, the thickness of the casing wall at the bottom of the grooves should equal or slightly exceed the normal casing wall thickness. The weight penalty of the thicker wall between the grooves is much less than the weight of a separate warhead, with both explosive and fragmentation material. Also, a separate warhead at the front end of the rocket motor could not produce the preferred elongated fragments.

Figure 4:
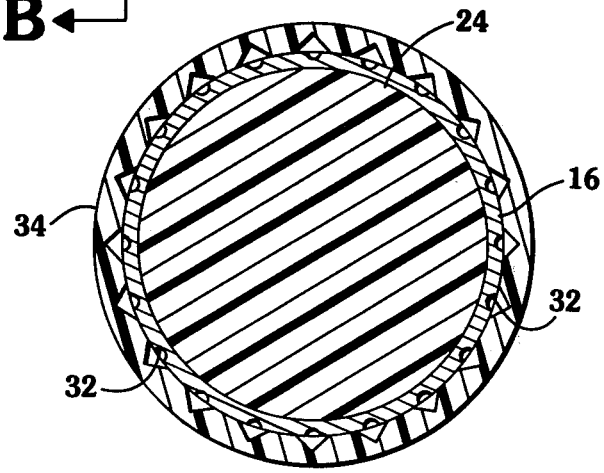
FIG. 4 is a schematic transverse section, similar to FIG. 3*a*, illustrating another case fragmentation method.

Alternate techniques for fragmenting the rocket motor casing into elongated fragments are schematically illustrated in FIG. 4 and 5.

As seen in a schematic transverse section view through the casing 16, a linear shaped cutting charge 34 can be placed over the casing exterior to cut the casing 16 along notches 32. The shaped charge 34 will be detonated at the appropriate time as the rocket approaches the target by a conventional sensor in control means 20, while the rocket motor is burning and casing 16 is pressurized. Once the cutting charge 34 has cut the casing 16 along the inner strip notches 32, the internal pressure spreads the strips in the manner indicated in FIG. 1. While it may be possible to place the cutting charges 34 on the inside of casing 16, complex physical and thermal insulation would be required to prevent ignition of the shaped charge as the propellant 24 burns during rocket flight.

Another method of causing momentary overpressure within casing 16 to fragment the casing along longitudinal notches is schematically illustrated in axial cross-section in FIG. 5. In this embodiment, a suitable pyrotechnic device 36 is located adjacent to nozzle 18. At the appropriate time as the rocket nears the target, the pyrotechnic 36 would be detonated, causing an overpressure wave to move through casing 16, as indicated by arrow 37 causing the casing to fragment along longitudinal notches (not shown) in the manner described in conjunction with FIGS. 2*a* and 2*b*, above. If desired, the pyrotechnic 36 could be located with the control means 20 in the nose of the missile. At the time of pyrotechnic detonation, most but not all of propellant 24 will have been consumed.

Other applications, ramifications and variations of this invention will occur to those skilled in the art upon reading this disclosure. Those are intended to be included within the scope of this invention as defined in the appended claims.

I claim:

1. A combined rocket motor and warhead which comprises an elongated rocket casing, a quantity of solid rocket propellant within said casing;

a rocket nozzle at one end of said casing;

fragmentation means comprising a plurality of substantially parallel scored lines along the length of said casing to cause said casing to fragment along said scored lines whereby a plurality of elongated fragments are produced, and momentary overpressure means, comprising a pyrotechnic device within said casing, to combine with the internal casing pressure caused by burning propellant to fracture said casing along said scored lines into a plurality of elongated fragments at a selected time prior to propellant exhaustion;

whereby the pressure of said burning propellant is the primary cause of casing fracture and further serves to spread said elongated fragments apart.

2. A combined rocket motor and warhead which comprises an elongated rocket casing, a quantity of solid rocket propellant within said casing;

a rocket nozzle at one end of said casing;

fragmentation means comprising a plurality of substantially parallel scored lines along the length of said casing and a plurality of linear shaped charges on the exterior surface of said casing adjacent to said scored lines to cut said casing into a plurality of strips upon ignition of said charges, and momentary overpressure means within said casing to combine with the internal casing pressure caused by burning propellant to spread said plurality of strips apart.

3. The method of producing a plurality of elongated strip-like fragments from a solid propellant rocket casing which comprises the steps of:

providing an elongated solid propellant motor casing containing propellant with a rocket nozzle at one end;

forming a plurality of parallel longitudinal scores along said casing;

igniting said rocket propellant to cause rocket motion along a selected path;

causing said casing to break along said scores at a selected time prior to propellant exhaustion by creating a momentary overpressure within said casing by exploding a pyrotechnic device within said casing, a significant portion of said overpressure resulting from the pressure of said burning propellant within said casing; and allowing the pressure within the casing to separate the resulting strip-like fragments;

whereby targets along the rocket path in advance of the point of fragment separation are impacted by said fragments.

4. The method of producing a plurality of elongated strip-like fragments from a solid propellant rocket casing which comprises the steps of:

providing an elongated solid propellant motor casing containing propellant with a rocket nozzle at one end;

forming a plurality of parallel longitudinal scores along said casing;

igniting said rocket propellant to cause rocket motion along a selected path;

causing said casing to break along said scores at a selected time prior to propellant exhaustion by igniting a plurality of linear shaped charges on the exterior surface of said casing adjacent to said scored lines to produce a plurality of strips; and allowing the pressure within the casing to separate the resulting strip-like fragments;

whereby targets along the rocket path in advance of the point of fragment separation are impacted by said fragments.

5. The combined rocket motor and warhead according to claim 1 or 2 wherein said scores are continuous with alternate ends of adjacent scores interconnected by transverse scores whereby at least some of said elongated fragments remain interconnected at alternate ends as the fragments spread apart.

6. The method according to claim 3 or 4 said scores are formed with continuous transverse scores between alternate pairs of ends of said parallel longitudinal scores so that at least some resulting adjacent fragment strips will remain interconnected at alternate ends as the strips separate.

* * * * *